US009514906B2

(12) United States Patent
Suzuki et al.

(10) Patent No.: US 9,514,906 B2
(45) Date of Patent: Dec. 6, 2016

(54) TEMPERATURE SWITCH AND FLUID HEATING DEVICE

(71) Applicant: CALSONIC KANSEI CORPORATION, Saitama-shi, Saitama (JP)

(72) Inventors: Daiju Suzuki, Saitama (JP); Naohisa Kamiyama, Saitama (JP); Hiroki Yoshioka, Saitama (JP); Atsushi Kawashima, Saitama (JP); Takeshi Satoh, Saitama (JP); Takeshi Ogasawara, Saitama (JP)

(73) Assignee: CALSONIC KANSEI CORPORATION, Saitama-Shi (JP)

( * ) Notice: Subject to any disclaimer, the term of this patent is extended or adjusted under 35 U.S.C. 154(b) by 29 days.

(21) Appl. No.: 14/420,193

(22) PCT Filed: Jul. 24, 2013

(86) PCT No.: PCT/JP2013/070077
§ 371 (c)(1),
(2) Date: Feb. 6, 2015

(87) PCT Pub. No.: WO2014/024684
PCT Pub. Date: Feb. 13, 2014

(65) Prior Publication Data

US 2015/0221466 A1 Aug. 6, 2015

(30) Foreign Application Priority Data

Aug. 9, 2012 (JP) ..... 2012-177474
Jul. 2, 2013 (JP) ..... 2013-138869

(51) Int. Cl.
*H05B 1/02* (2006.01)
*H01H 37/34* (2006.01)

(Continued)

(52) U.S. Cl.
CPC ..... *H01H 37/34* (2013.01); *H01H 37/04* (2013.01); *H01H 37/52* (2013.01); *H01H 37/5436* (2013.01); *H05B 1/0213* (2013.01); *H05B 1/0244* (2013.01); *H01H 37/043* (2013.01)

(58) Field of Classification Search
CPC .. H01H 1/34; H01H 37/043; H01H 34/5436; H01H 37/04; H01H 37/52; H05B 1/0213; H05B 1/0244; H05B 1/0291; H05B 1/0202
USPC ..... 219/491, 494, 512, 448.11, 448.18
See application file for complete search history.

(56) References Cited

U.S. PATENT DOCUMENTS 2,924,698 A * 2/1960 Jepson ..... H05B 1/0213 219/441
5,404,421 A * 4/1995 Wallace ..... H05B 3/82 392/454

(Continued)

FOREIGN PATENT DOCUMENTS

CN 2106412 U 6/1992
JP 62-62935 U 4/1987

(Continued)

*Primary Examiner* — Mark Paschall
(74) *Attorney, Agent, or Firm* — Foley & Lardner LLP

(57) ABSTRACT

A temperature switch performs switching according to temperature of a heater. The temperature switch includes a bimetal that is deformed when the temperature of the heater reaches set temperature, a switch mechanism that is opened and closed by deformation of the bimetal, and a housing member that houses the bimetal and the switch mechanism, and that is able to conduct heat to the bimetal. The heater includes a pair of heat generation units that is adjacent to each other. The housing member includes a contact portion that is formed to project and that is inserted between the pair of heat generation units.

11 Claims, 16 Drawing Sheets

(51) Int. Cl.

| | |
|---|---|
| ***H01H 37/54*** | (2006.01) |
| ***H01H 37/52*** | (2006.01) |
| *H01H 37/04* | (2006.01) |

(56) References Cited

U.S. PATENT DOCUMENTS

| | | | | |
|---|---|---|---|---|
| 2002/0135453 | A1 | 9/2002 | Russell et al. | |
| 2004/0066269 | A1* | 4/2004 | Nguyen | H01H 37/14 337/343 |
| 2006/0208846 | A1* | 9/2006 | Davis | H01H 37/54 337/333 |

FOREIGN PATENT DOCUMENTS

| | | |
|---|---|---|
| JP | 2-59541 U | 5/1990 |
| JP | 2-97739 U | 8/1990 |
| JP | 2011-075980 | 4/2011 |

* cited by examiner

TEMPERATURE SWITCH AND FLUID HEATING DEVICE

TECHNICAL FIELD

The present invention relates to a temperature switch, and a fluid heating device in which the temperature switch is used.

BACKGROUND ART

A temperature switch that detects the temperature of a heater and performs switching when the temperature of the heater reaches the set temperature has been used conventionally. When using the temperature switch, it is necessary to keep a contact pressure between itself and the heater properly, in order to transfer heat from the heater efficiently.

JP62-62935A discloses the structure of attaching a temperature sensing member for detecting the temperature of a pipe onto the pipe. With this attachment structure, the temperature sensing member is attached to the pipe by clip-shaped fastening hardware.

SUMMARY OF INVENTION

According to the attachment structure of JP62-62935A, however, it is necessary to increase rigidity of the clip, in order to secure the contact pressure between the temperature sensing member and the pipe. When the rigidity of the clip is increased, an assembling property of the clip may be deteriorated, and deformation of the clip and the temperature sensing member may be caused at the time of assembly.

The present invention is made in view of the above-described problems, and its object is to provide a temperature switch capable of securing the contact pressure between itself and the heater with ease.

According to one aspect of the present invention, a temperature switch that is configured to perform switching according to temperature of a heater, includes a bimetal that is deformed when the temperature of the heater reaches set temperature, a switch mechanism that is opened and closed by deformation of the bimetal, and a housing member that houses the bimetal and the switch mechanism, and that is configured to conduct heat to the bimetal. The heater includes a pair of heat generation units that is adjacent to each other. The housing member includes a contact portion that is formed to project and that is inserted between the pair of heat generation units.

DESCRIPTION OF EMBODIMENTS

Hereinafter, embodiments of the present invention will be explained with reference to the drawings.

First Embodiment

Hereinafter, a bimetal switch 10 as a temperature switch, and a heater device 100 as a fluid heating device, in which the bimetal switch 10 is used, according to a first embodiment of the present invention will be explained with reference to FIG. 1 to FIG. 7.

The heater device 100 is used in air conditioning devices (heating devices) for vehicles that are mounted on HEVs (Hybrid Electric Vehicles), EVs (Electric Vehicles) and the like.

Figure 1:
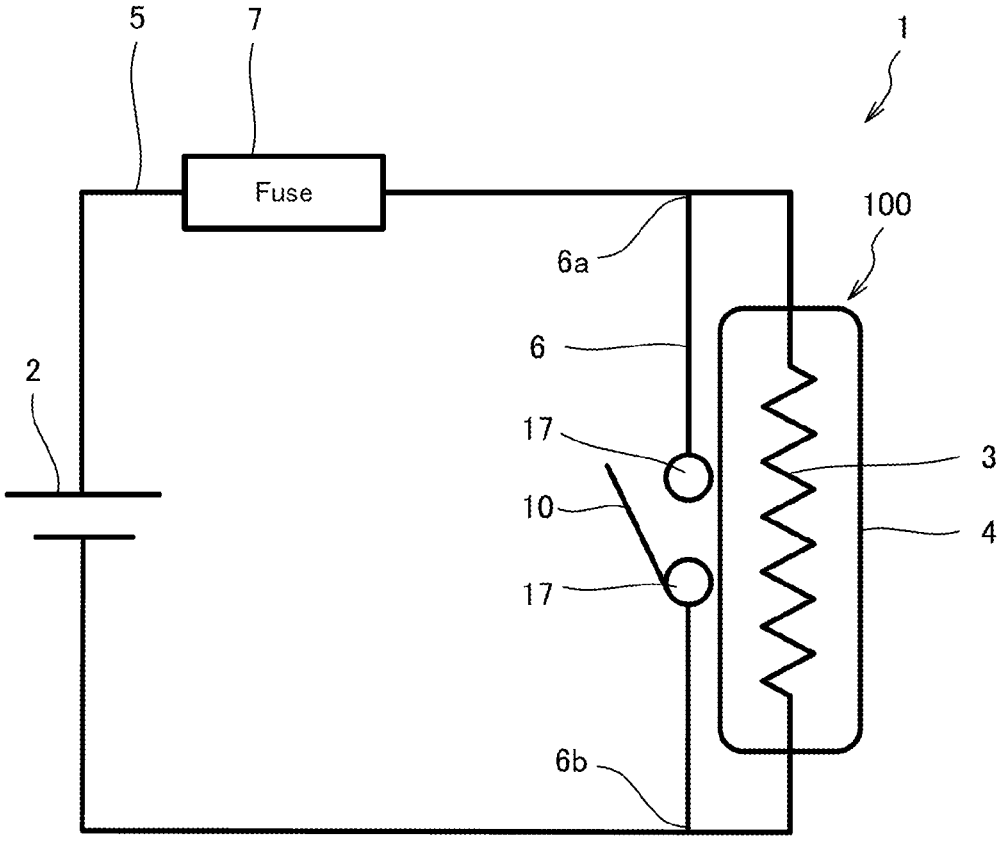
FIG. 1 is a circuit diagram of an electric circuit to which a fluid heating device, to which a temperature switch according to an embodiment of the present invention is applied, is applied.

First, an electric circuit 1, to which the heater device 100 is applied, will be explained with reference to FIG. 1.

The heater device 100 is provided with a heater 3 that operates by a current supplied from a DC power supply 2 as a power supply, and a tank 4 through which a coolant as a fluid to be heated by the heater 3 circulates.

The electric circuit 1 is provided with the DC power supply 2 that supplies power to the heater 3, a short-circuit line 6 that establishes a short circuit in the supply line 5 between the upstream side and the downstream side of the heater 3 when the temperature of the heater 3 reaches the set temperature, and a power fuse 7 that is provided on the supply line 5 between the DC power supply 2 and the short-circuit line 6.

The DC power supply 2 is a high-voltage battery that is mounted on the HEV, the EV and the like, and that supplies power to a driving motor (not illustrated), too. An output voltage of the DC power supply 2 is a high voltage of 30 V or more, which is 350 V in this case. The current from the DC power supply 2 is supplied to the heater 3 via the supply line 5. An AC power supply, instead of the DC power supply 2, may be used as the power supply.

One end 6*a* of the short-circuit line 6 is connected to the position downstream of the power fuse 7 and upstream of the heater 3, in the direction of a current flow of the supply line 5, and the other end 6*b* is connected to the position downstream of the heater 3 and upstream of the DC power supply 2. The short-circuit line 6 is an electric conductor with a very small resistance and connects the one end 6*a*, connected to the supply line 5, and the other end 6*b*.

The short-circuit line 6 has a bimetal switch 10 that is switched to an energized state when the temperature of the heater 3 reaches the set temperature. The short-circuit line 6 is not shorted out when the temperature of the heater 3 is less than the set temperature. When the temperature of the heater 3 reaches the set temperature and the bimetal switch 10 is switched to the energized state, the short-circuit line 6 is brought into a short-circuited state.

The power fuse 7 is cut by a large current that flows instantaneously when the short-circuit line 6 is shorted out. As the resistance of the short-circuit line 6 is very small, an extremely large current, as compared with the current flowing through the heater 3, is made to flow through the power fuse 7 when the short-circuit line 6 is shorted out. The power fuse 7 is cut by the current supplied from the DC power supply 2, before heat generated by a harness (not illustrated) for supplying the current exceeds the allowable temperature. This allowable temperature is set to such temperature that parts forming the harness are not damaged.

As described thus far, the electric circuit 1 is provided with a safety device that interrupts the current supplied from the DC power supply 2 to the heater 3, when the temperature of the heater 3 increases beyond a range of the allowable temperature.

Next, the configuration of the heater device 100 will be explained with reference to FIG. 2 to FIG. 7.

Figure 2:
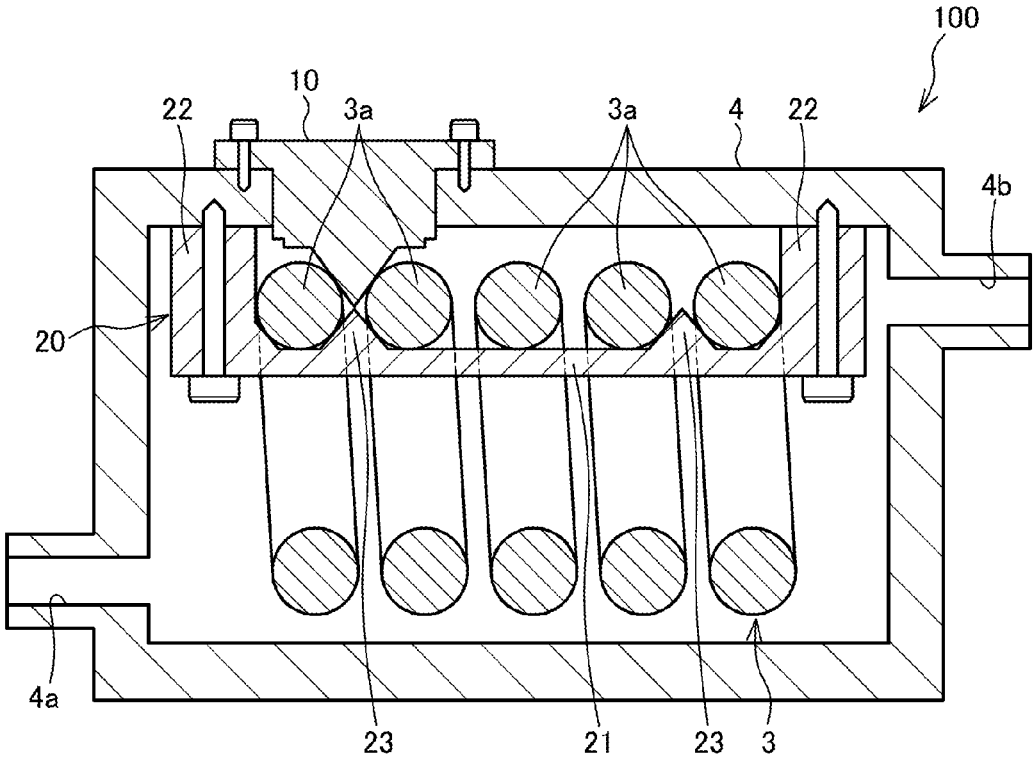
FIG. 2 is a cross-sectional view of the fluid heating device according to a first embodiment of the present invention.

As illustrated in FIG. 2, the heater device 100 is provided with the heater 3, the bimetal switch 10 that performs switching according to the temperature of the heater 3, the tank 4 that receives the heater 3 and that allows the fluid, supplied to its inside, to be heated by the heater 3 and to pass therethrough, and a holding member 20 that holds the heater 3 inside the tank 4.

The heater 3 is a sheathed heater that generates heat by energization, or a PTC (Positive Temperature Coefficient) heater. From the viewpoint of costs, it is desirable that the heater 3 be the sheathed heater. The heater 3 is housed in the tank 4, and heats the coolant used in the heating device for the vehicle.

Figure 3:
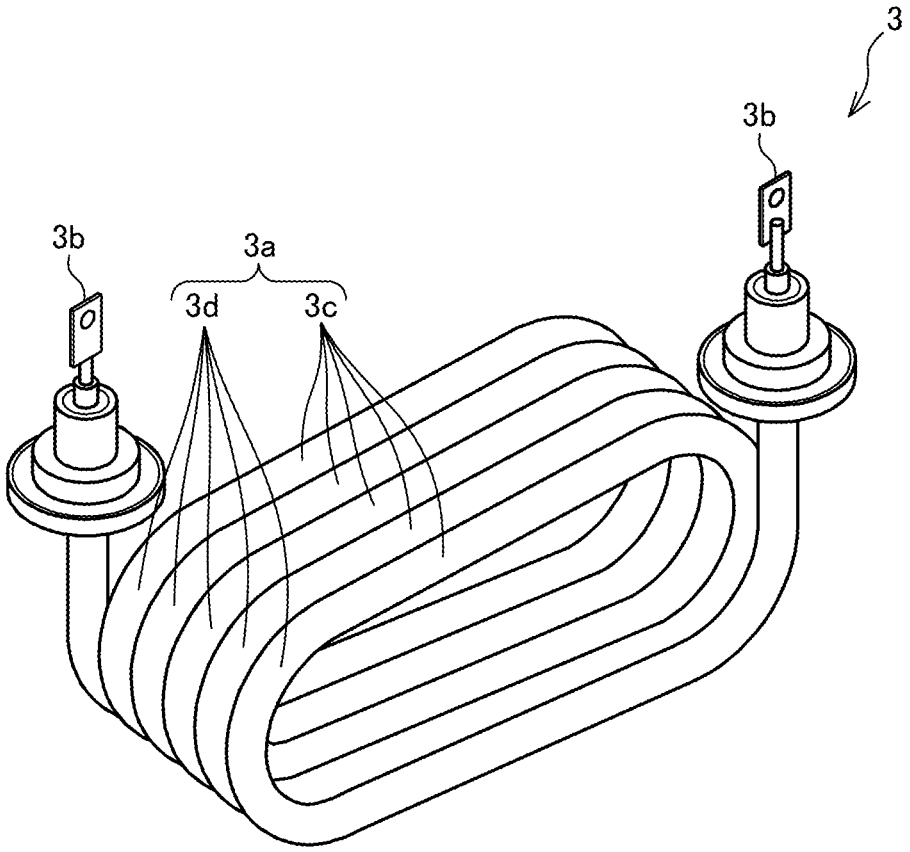
FIG. 3 is a perspective view of a heater of the fluid heating device.

As illustrated in FIG. 3, the heater 3 includes a plurality of heat generation units 3*a* that are in parallel with each other, and terminal units 3*b* formed at both ends, to which the power is supplied. The heater 3 is formed to have a winding shape that is wound in such a manner that the heat generation units 3*a* are adjacent to each other in order. The shape of the heater 3 may not necessarily be the winding shape, as long as the heater 3 includes the heat generation units 3*a* that are adjacent to each other.

Each of the heat generation unit 3*a* is formed to have a ring-shaped cross section. In this case, the cross section of the heat generation unit 3*a* has a round shape. The heat generation unit 3*a* includes a straight portion 3*c* that is formed to have a straight shape, and a curved portion 3*d* as a coupling portion that couples the end of the straight portion 3*c* to another straight portion 3*c* that is adjacent thereto.

As illustrated in FIG. 2, the tank 4 is provided with a supply passage 4*a* through which the coolant is supplied, and a discharge passage 4*b* through which the coolant, heated by the heater 3, is discharged. The coolant that circulates through the tank 4 is cooling water such as an antifreeze, for example.

As illustrated in the cross-sectional view of FIG. 2, the bimetal switch 10 is attached to the tank 4 so as to sandwich the heat generation units 3*a* of the heater 3 between itself and the holding member 20. The bimetal switch 10 is inserted from the outside to the inside of the tank 4, and is fastened to the outside of the tank 4 by bolts. The bimetal switch 10 is pressed against the heater 3 by a fastening force of the bolts. The bimetal switch 10 performs the switching according to the temperature of the heater 3.

Figure 4A:
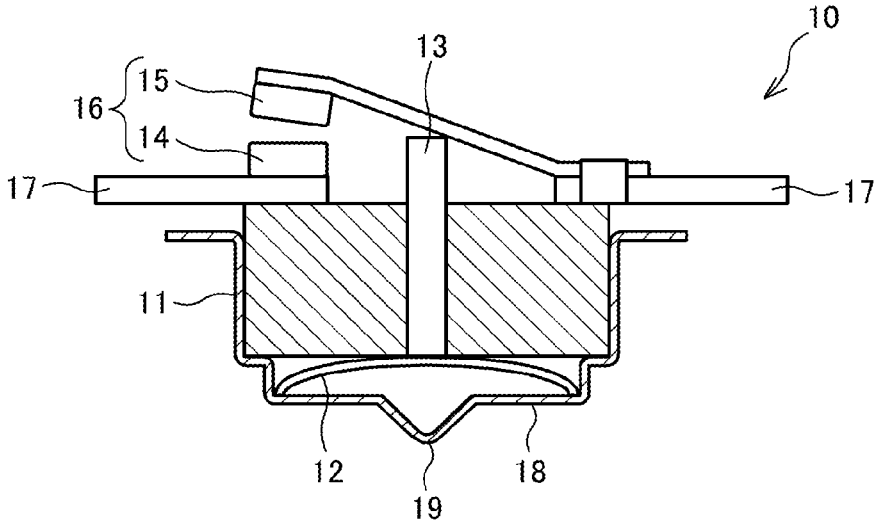
FIG. 4A is a cross-sectional view illustrating an open state of the temperature switch.
Figure 4B:
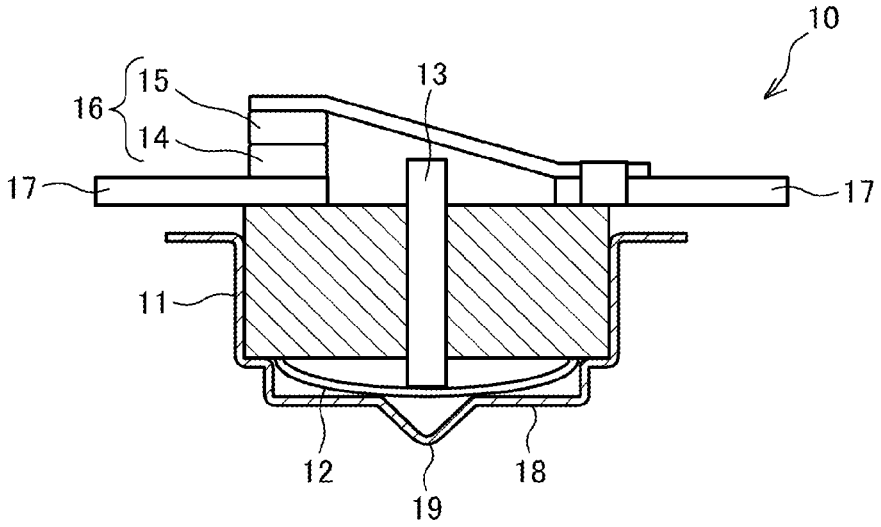
FIG. 4B is a cross-sectional view illustrating an energized state of the temperature switch.

As illustrated in FIG. 4A and FIG. 4B, the bimetal switch 10 is provided with a disk-shaped bimetal 12 that is deformed when its temperature reaches the critical temperature, a pin 13 that moves in the axial direction by the deformation of the bimetal 12, a switch mechanism 16 that is opened and closed by the deformation of the bimetal 12, and a casing 11 as a housing member that houses the bimetal 12 and the switch mechanism 16. The bimetal switch 10 is switched between an open state, in which the flow of the current is interrupted by the deformation of the bimetal 12, and the energized state, in which the flow of the current is permitted. Incidentally, only a part of the casing 11 is illustrated in FIG. 4A and FIG. 4B, and a cover unit that covers the switch mechanism 16 is omitted.

The bimetal 12 is set to reach the critical temperature when the temperature of the heater 3 reaches the set temperature. When the temperature of the bimetal 12 is lower than the critical temperature, it is projected upwardly as illustrated in FIG. 4A, and when the temperature of the bimetal 12 reaches the critical temperature, it is deformed and projected downwardly as illustrated in FIG. 4B.

The switch mechanism 16 is provided with a fixed contact 14 that is fixed inside the casing 11, and a movable contact 15 that is biased toward the fixed contact 14. The fixed contact 14 and the movable contact 15 are respectively connected to terminals 17. The bimetal switch 10 is inserted in the short-circuit line 6 via the pair of terminals 17 (refer to FIG. 1).

When the bimetal 12 reaches the critical temperature and is deformed to project downwardly, as illustrated in FIG. 4B, the movable contact 15 is brought into contact with the fixed contact 14, and thus the energization is made possible. Thereby, the bimetal switch 10 is switched to the energized state, and the short-circuit line 6 is changed to the short-circuited state.

The critical temperature, at which the bimetal 12 is deformed to project downwardly, is set at 130° C., for example. Meanwhile, the temperature, at which the bimetal 12 is deformed from the downwardly projecting state to the upwardly projecting state again, is set at −40° C., for example. Thus, a differential is set in such a manner that the bimetal 12, after being deformed to project downwardly, does not easily return to the upwardly projecting state within a temperature range of a normal usage environment.

The casing 11 is provided with a bottom surface 18 that faces the bimetal 12, and a contact portion 19 that is formed to project from the bottom surface 18 toward the outside. The bimetal 12 is housed inside the casing 11 in a heat conductive manner. According to this embodiment, the edge of the bimetal 12 is in direct contact with the casing 11 before the bimetal 12 is deformed. Incidentally, a heat transfer member, such as a heat conductive sheet formed by, for example, silicone or the like, may be laid between the bimetal 12 and the casing 11.

Figure 5A:
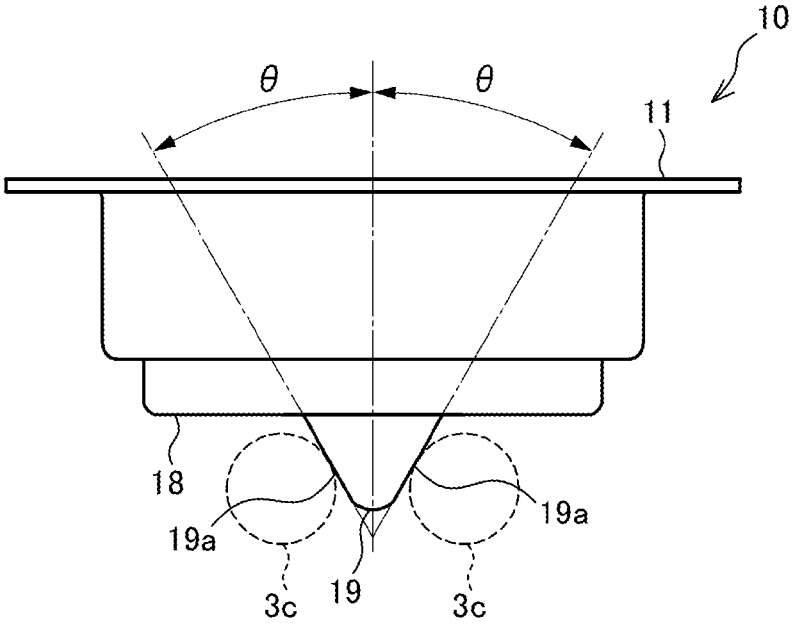
FIG. 5A is a front view of a housing member of the temperature switch.

Before the bimetal 12 is deformed, as illustrated in FIG. 5A, the portion where the bottom surface 18 is in direct contact with the bimetal 12 (the vicinity of the portion where the heat transfer member and the bimetal are in contact with each other when the heat transfer member is interposed as described above) is separated from the straight portions 3*c* of the heater 3, when the bimetal switch 10 is attached to the tank 4. This makes it possible to prevent the deformation of the bottom surface 18, caused by being abutted against the heater 3, from affecting the bimetal 12 that is housed inside the casing 11.

The contact portion 19 is inserted between a pair of the adjacent straight portions 3*c* of the heater 3. The contact portion 19 is in contact with the straight portions 3*c* of the heater 3. The contact portion 19 is projected to taper down toward the tip. The contact portion 19 is formed to incline from the central axis that is perpendicular to the heater 3, by a contact angle θ.

When the bimetal switch 10 is attached to the tank 4, the contact portion 19 is formed in such a manner that the portion located between the pair of adjacent straight portions 3*c* is larger than a distance between the pair of adjacent straight portions 3*c*. Thus, when the contact portion 19 is inserted into the heater 3, the space between the pair of adjacent straight portions 3*c* is widened by the contact portion 19. For this reason, when the bimetal switch 10 is attached to the tank 4, a contact pressure is generated between the contact portion 19 and the straight portions 3*c*, due to a spring force of the heater 3.

Figure 5B:
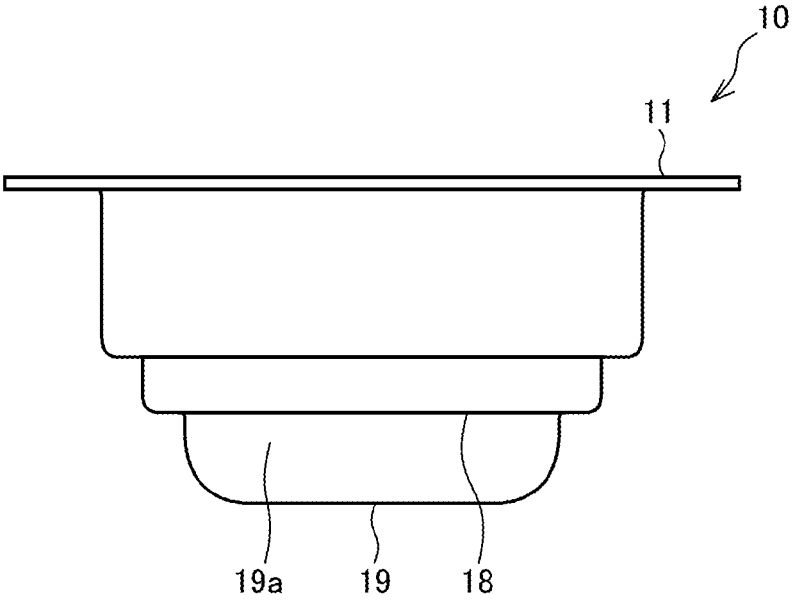
FIG. 5B is a side view of FIG. 5A.

As illustrated in FIG. 5B, the contact portion 19 is extended along the straight portions 3*c* of the heater 3. Thereby, a pair of plane surfaces 19*a* that is able to circumscribe the straight portions 3*c* of the heater 3 is formed on the contact portion 19. This makes it possible for the contact portion 19 to abut against the straight portions 3*c* in a linear manner.

Instead of the pair of plane surfaces 19*a* formed on the contact portion 19, a pair of curved surfaces that can be in surface-contact with the straight portions 3*c* of the heater 3 may be provided. When the curved surfaces are formed, a contact area between the heater 3 and the bimetal switch 10 increases, which makes it possible to further improve heat transfer efficiency.

As described thus far, the casing 11, in which the bimetal 12 is housed in a heat conductive manner, includes the contact portion 19 that is formed to project and that is inserted between the pair of adjacent straight portions 3*c* of the heater 3. For this reason, the contact pressure is generated between the contact portion 19 and the straight portions 3*c*, due to the spring force of the heater 3, only by inserting the contact portion 19 between the pair of straight portions 3*c*. This makes it possible to easily secure the contact pressure between the bimetal switch 10 and the heater 3.

Further, the contact portion 19 that is formed to taper down toward the tip can absorb manufacturing tolerance and assembling tolerance of the bimetal switch 10, the heater 3, the tank 4 and the like. Thus, it is not necessary to strictly manage dimensional tolerance of the respective parts, as a result of which cost reduction can be made possible.

As illustrated in FIG. 2, the holding member 20 is fastened to the inner surface of the tank 4 by bolts. The holding member 20 is provided with a holding portion 21 that holds the inner circumference of the wound heater 3, and a supporting portion 22 that supports both ends of the holding portion 21 to the inner surface of the tank 4.

The holding portion 21 holds the straight portions 3*c* in such a manner that the heater 3 is located by being separated from the inner surface of the tank 4 by a predetermined distance. Thereby, even when the bimetal switch 10 is attached to the tank 4 and the contact portion 19 is inserted, the heater 3 does not escape in the direction separating from the bimetal switch 10.

Further, the holding portion 21 includes protruding portions 23 that hold the straight portions 3*c* at both ends of the heater 3 in such a manner to prevent them from moving toward the outer sides, when the bimetal switch 10 is attached to the tank 4 and the contact portion 19 is inserted. At this time, the straight portions 3*c* at both ends of the heater 3 may be fixed to the holding portion 21 by brazing or the like. Thus, the holding member 20 is able to fix one of the pair of adjacent heat generation units 3*a*, between which the contact portion 19 of the bimetal switch 10 is inserted, and to hold the other heat generation unit 3*a* to be able to separate from the one heat generation unit 3*a*.

When the bimetal switch 10 is attached to the tank 4 and the contact portion 19 is inserted, one heat generation unit 3*a* is fixed to the holding member 20 and the other heat generation unit 3*a* is separated from the one heat generation unit 3*a*. Thereby, the spring force of the heat generation units 3*a* is applied to sandwich the contact portion 19, as a result of which the contact pressure is generated between the contact portion 19 and the heat generation units 3*a*.

Figure 6:
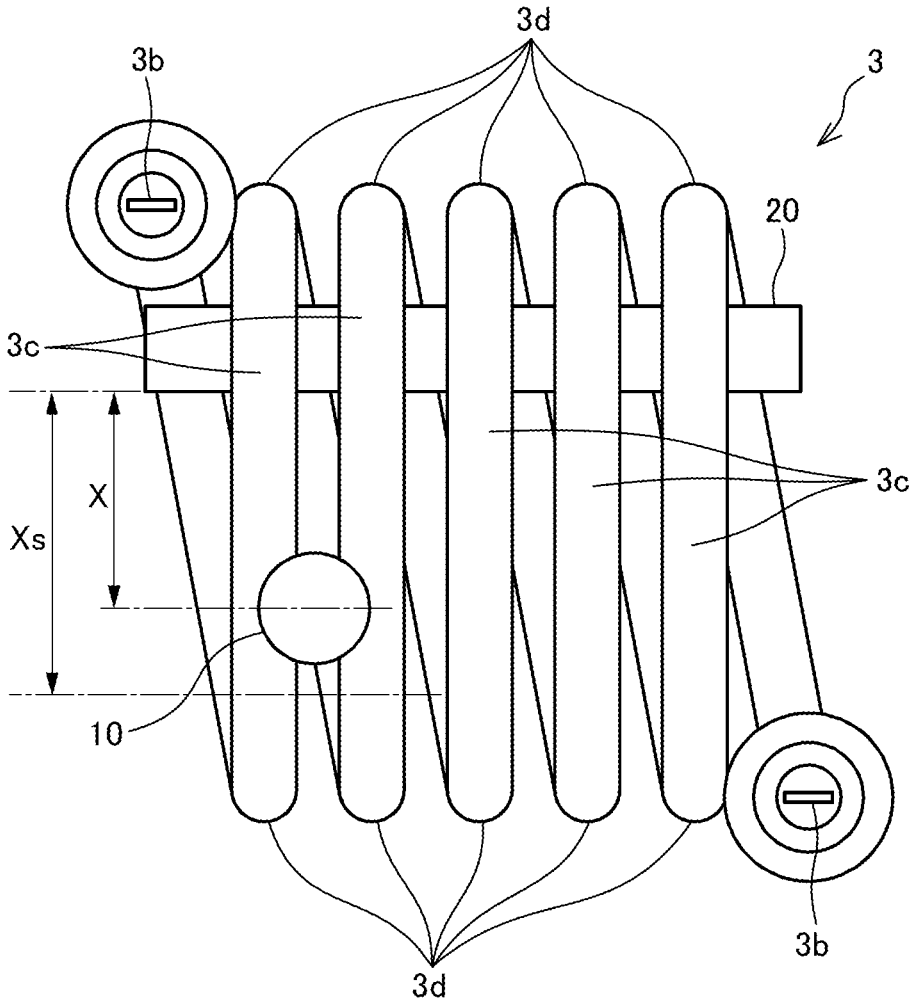
FIG. 6 is a view illustrating positional relationship between a holding member that holds the heater and the temperature switch.

As illustrated in FIG. 6, the bimetal switch 10 is disposed by being separated from the holding member 20 by a distance X, in the direction along the straight portions 3*c*. Assuming that a pressing force of the bimetal switch 10 against the heater 3 is W, a longitudinal elastic modulus of the heater 3 is E, a cross-sectional secondary moment of the heater 3 is $I_Z$, a displacement amount of the contact portion 19 of the bimetal switch 10, inserted in the heater 3 in advance, is $z_P$, and the contact angle of the contact portion 19 (refer to FIG. 5A) is θ, this distance X can be found by the expression (1).

[Expression 1]

$$X = \sqrt[3]{\frac{3EI_z z_p \sin\theta}{W}} \tag{1}$$

In addition, assuming that a maximum displacement amount of the contact portion 19 of the bimetal switch 10, inserted in the heater 3, is $z_{max}$, a maximum reaction force W' applied to the bimetal switch 10 at this time can be found by the expression (2).

[Expression 2]

$$W' = \frac{3EI_z z_{max} \sin\theta}{X^3} \tag{2}$$

Assuming that a length from the end of the holding member 20 to the end of the straight portions 3*c* of the heater 3 is $X_s$, the distance X is set to be shorter than $X_s$. In addition, the contact angle θ is set in such a manner that attaching strength of the bimetal switch 10 to the tank 4 is greater than W'.

When the setting is made like this, it is possible to properly keep the contact pressure between the contact portion 19 of the bimetal switch 10 and the straight portions 3*c* of the heater 3, by using a spring property of the heater 3. Further, it is possible to allow the size of the reaction force applied from the heater 3 to the bimetal switch 10 to be within a design value range. This makes it possible to improve heat transfer responsivity of the bimetal switch 10, and to prevent an excessive reaction force from being applied to the bimetal switch 10.

Figure 7:
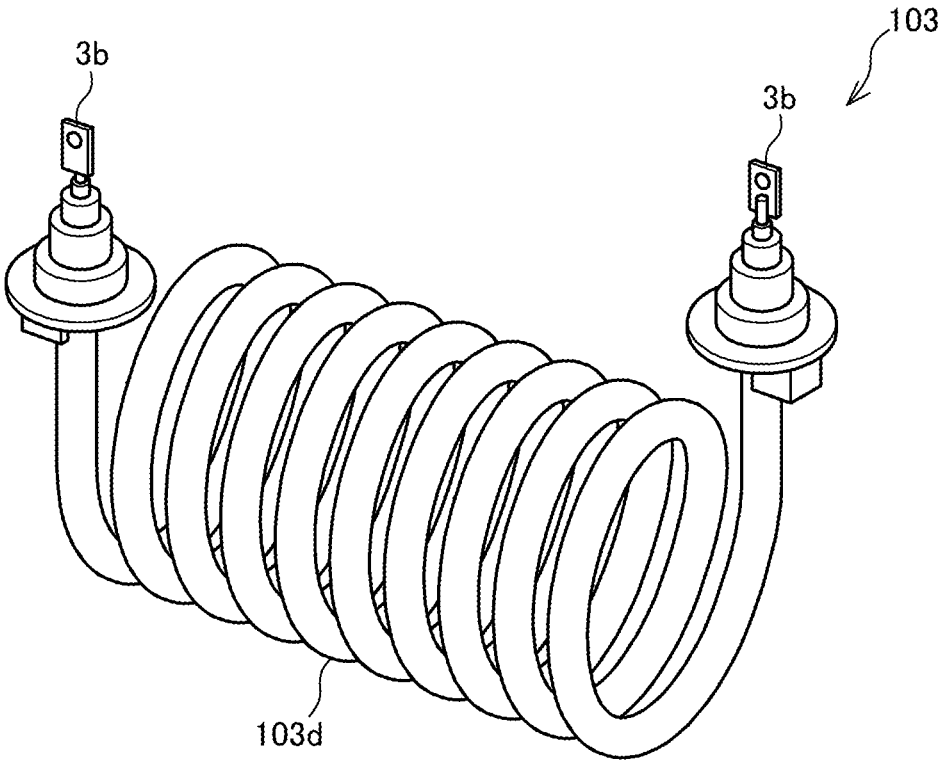
FIG. 7 is a perspective view of a modification example of the heater of the fluid heating device.

Incidentally, the case of using the heater 3 having the straight portions 3*c* has been explained in the above-described embodiment. However, this is not restrictive, and a heater 103 that is formed only by a curved portion 103*d* and that does not have the straight portions, as illustrated in FIG. 7, may be used.

The following effects can be obtained according to the above-described embodiment.

The casing 11, in which the bimetal 12 is housed in a heat conductive manner, includes the contact portion 19 that is formed to project and that is inserted between the pair of adjacent straight portions 3*c* of the heater 3. For this reason, the contact pressure is generated between the contact portion 19 and the straight portions 3*c*, due to the spring force of the heater 3, only by inserting the contact portion 19 between the pair of straight portions 3*c*. This makes it possible to easily secure the contact pressure between the bimetal switch 10 and the heater 3.

Further, the contact portion 19 that is formed to taper down toward the tip can absorb the manufacturing tolerance and the assembling tolerance of the bimetal switch 10, the heater 3, the tank 4 and the like. Thus, it is not necessary to strictly manage the dimensional tolerance of the respective parts, as a result of which the cost reduction can be made possible.

Incidentally, the contact portion 19 of the bimetal switch 10 is formed to project and taper down toward the tip, according to the above-described first embodiment. Instead of this, the contact portion 19 may be formed to project vertically from the bottom surface 18.

In this case, the contact portion 19 is formed in such a manner that a width between the pair of plane surfaces 19*a* that is formed in parallel to each other is larger than a distance between the pair of adjacent straight portions 3*c* of the heater 3, when the bimetal switch 10 is attached to the tank 4. Thus, when the contact portion 19 is inserted into the heater 3, the space between the pair of adjacent straight portions 3*c* is widened by the contact portion 19. For this reason, the contact pressure is generated between the contact portion 19 and the straight portions 3*c*, due to the spring force of the heater 3, even when the contact portion 19 is formed to project vertically from the bottom surface 18.

Second Embodiment

Figure 8:
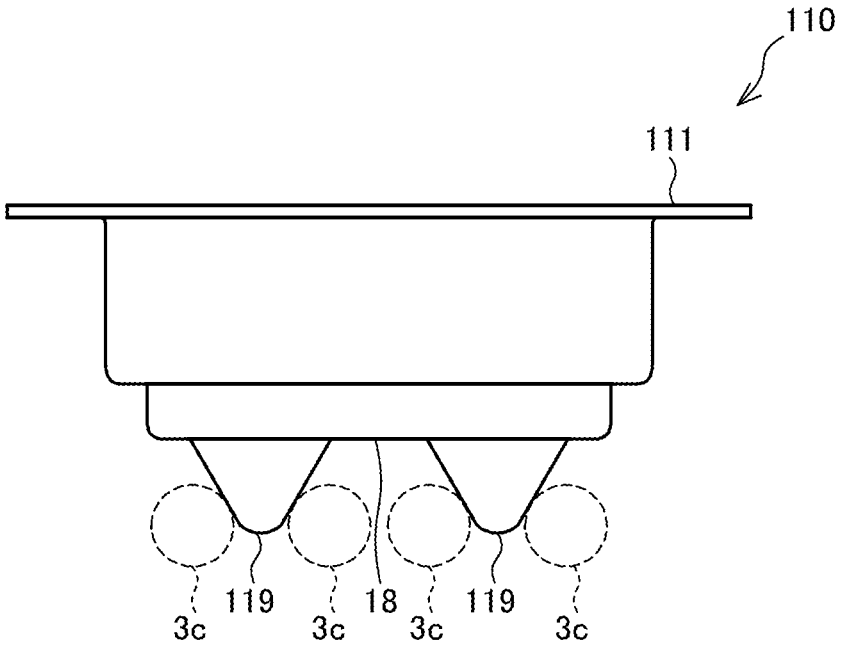
FIG. 8 is a front view of the temperature switch of the fluid heating device according to a second embodiment of the present invention.

Next, a second embodiment of the present invention will be explained with reference to FIG. 8. In the embodiments that will be explained below, the same reference numerals and symbols are given to designate the similar structures as those of the first embodiment, and repeated explanations are omitted as appropriate.

With the bimetal switch 10 of the first embodiment, a single piece of the contact portion 19 is formed on the casing 11. With a bimetal switch 110 of the second embodiment, however, a pair of contact portions 119 is formed on a casing 111. As the internal structure of the bimetal switch 110 is similar to that of the bimetal switch 10, explanations are omitted.

The pair of contact portions 119 is provided while being separated from each other with a predetermined distance therebetween. Each of the pair of contact portions 119 is extended along the straight portions 3*c* and in parallel to each other. The pair of contact portions 119 is in contact with the first to the fourth straight portions 3*c* that are adjacent to each other in order.

Specifically, one of the contact portions 119 is inserted between the first straight portion 3*c* and the second straight portion 3*c*, and the other contact portion 119 is inserted between the third straight portion 3*c* and the fourth straight portion 3*c*. At this time, either one of the pair of straight portions 3*c*, with which the contact portion 119 is in contact, is fixed by a holding member (not illustrated), and the other straight portion 3*c* is held to be able to separate from the one straight portion 3*c*.

Thus, similarly to the above-described first embodiment, the contact pressure is generated between the contact portions 119 and the straight portions 3*c*, due to the spring force of the heater 3, only by inserting the contact portions 119 between the pairs of straight portions 3*c*. This makes it possible to easily secure the contact pressure between the bimetal switch 10 and the heater 3.

In addition, the bimetal switch 110 has twice as large contact area with the heater 3 as that of the above-described bimetal switch 10 of the first embodiment. This makes it possible to further improve the heat transfer responsivity of the bimetal switch 110.

Incidentally, although the pair of contact portions 119 is formed in the bimetal switch 110, this is not restrictive, and three or more contact portions 119 may be formed.

Third Embodiment

Next, a third embodiment of the present invention will be explained with reference to FIG. 9 to FIG. 12.

Figure 9:
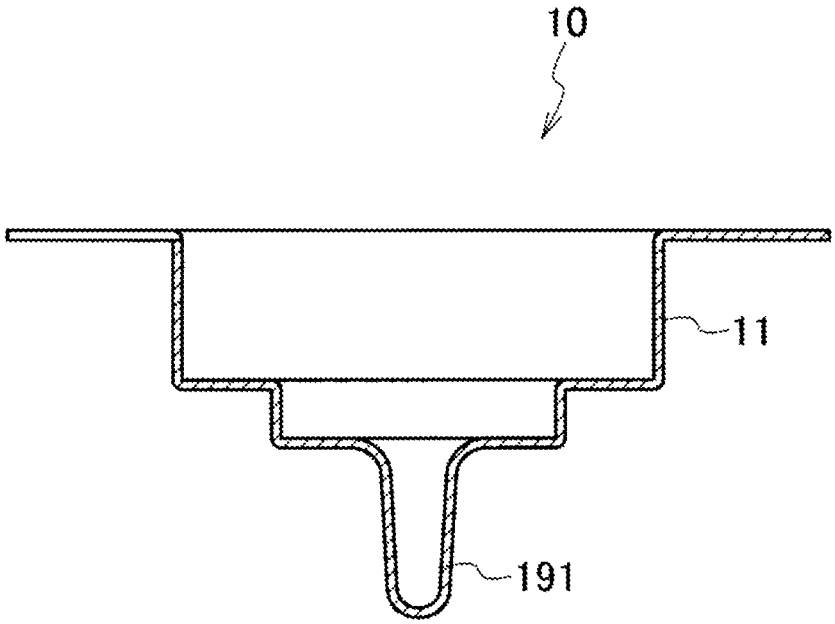
FIG. 9 is a cross-sectional view of a housing member of the temperature switch of the fluid heating device according to a third embodiment of the present invention.

The bimetal switch 10 of the third embodiment has the same structure as that of the bimetal switch 10 of the first embodiment, except for the structure of a contact portion 191. The contact portion 191 of the bimetal switch 10 according to this embodiment, as illustrated in FIG. 9, is formed to have a small gradient so that a contact angle θ, when being in contact with the heater 3, becomes smaller. When the contact portion 191 is formed by press molding, for example, it is supposed that the size is equal to the gradient required for releasing the mold.

Figure 10:
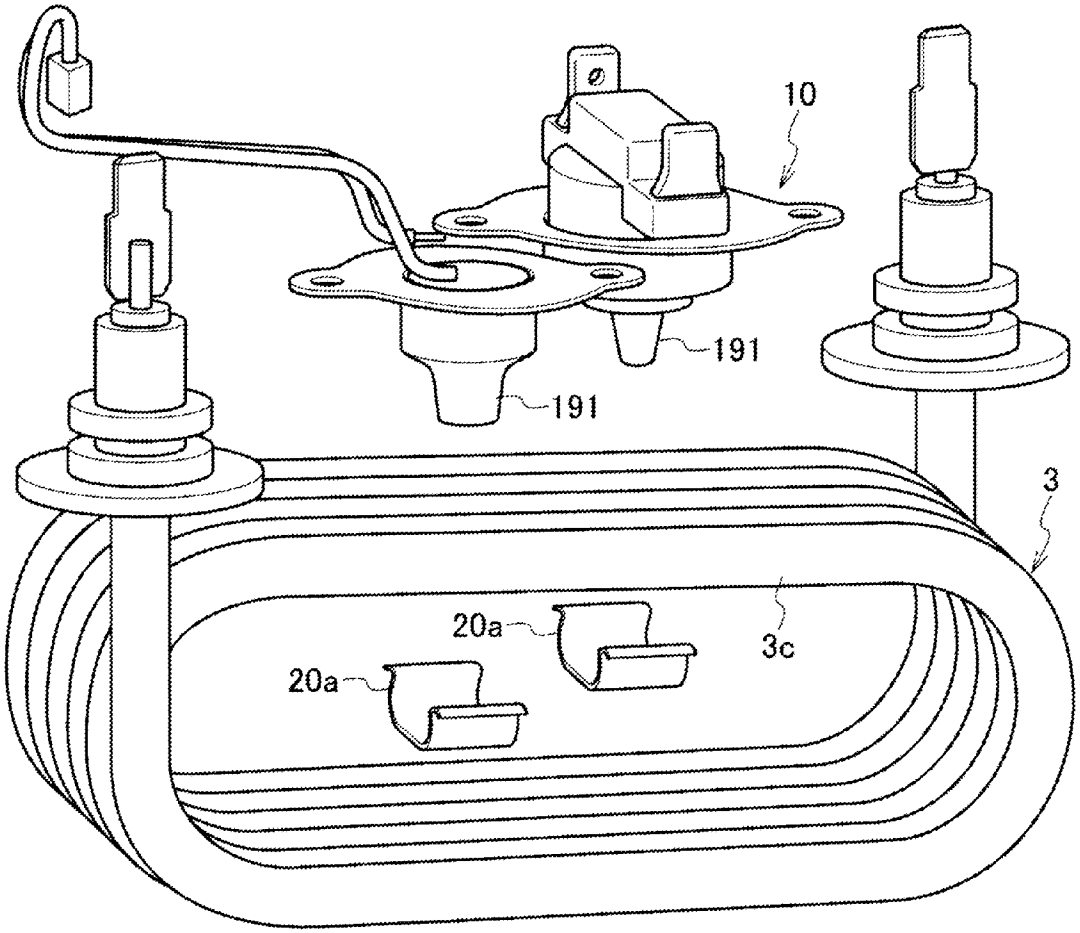
FIG. 10 is an exploded perspective view of the heater and the temperature switch.
Figure 11:
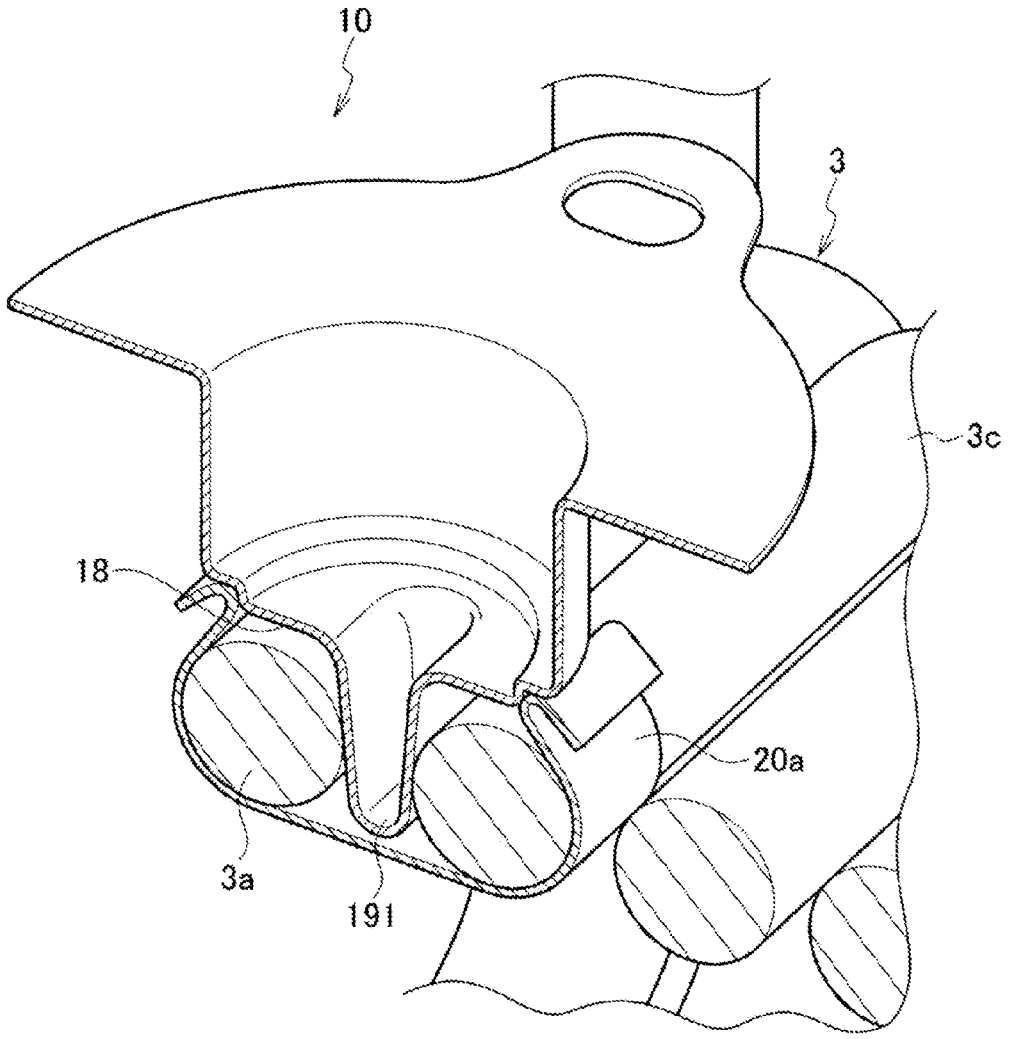
FIG. 11 is a cross-sectional perspective view of the housing member of the temperature switch.

In addition, a holding member 20*a* of this embodiment is a plate-shaped member (clip-shaped member) that is formed to sandwich the pair of adjacent straight portions 3*c*, as illustrated in FIG. 10 and FIG. 11.

Figure 12:
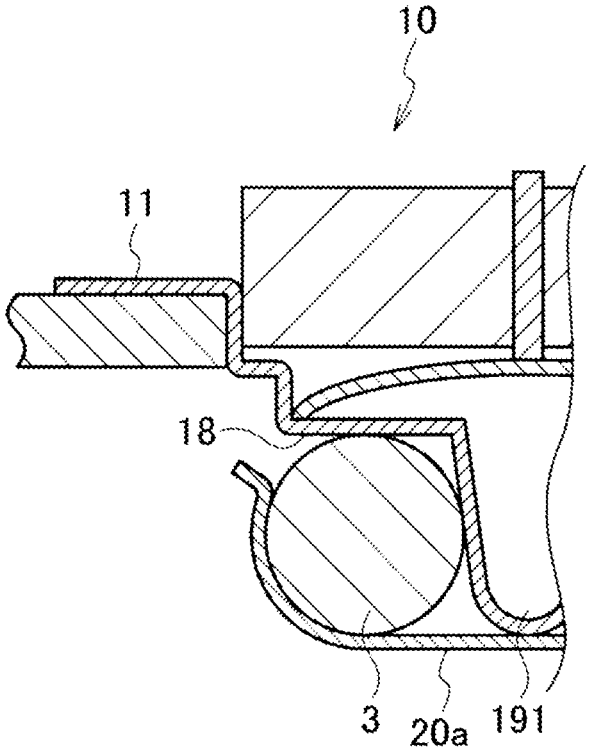
FIG. 12 is a partial cross-sectional view illustrating a contact state between the temperature switch and the holding member.

According to this embodiment as illustrated in FIG. 10 and FIG. 11, the holding member 20*a* sandwiches the pair of straight portions 3*c* while the contact portion 191 of the bimetal switch 10 is inserted between the pair of straight portions 3*c*. Thereby, the contact pressure is generated between the contact portion 191 and the straight portions 3*c*. Although FIG. 11 illustrates the state in which the head of the heater 3 is not in contact with the bottom surface 18 of the bimetal switch 10, the head of the heater 3 may be brought into contact with the bottom surface 18 of the bimetal switch 10, as illustrated in FIG. 12.

Fourth Embodiment

Figure 14:
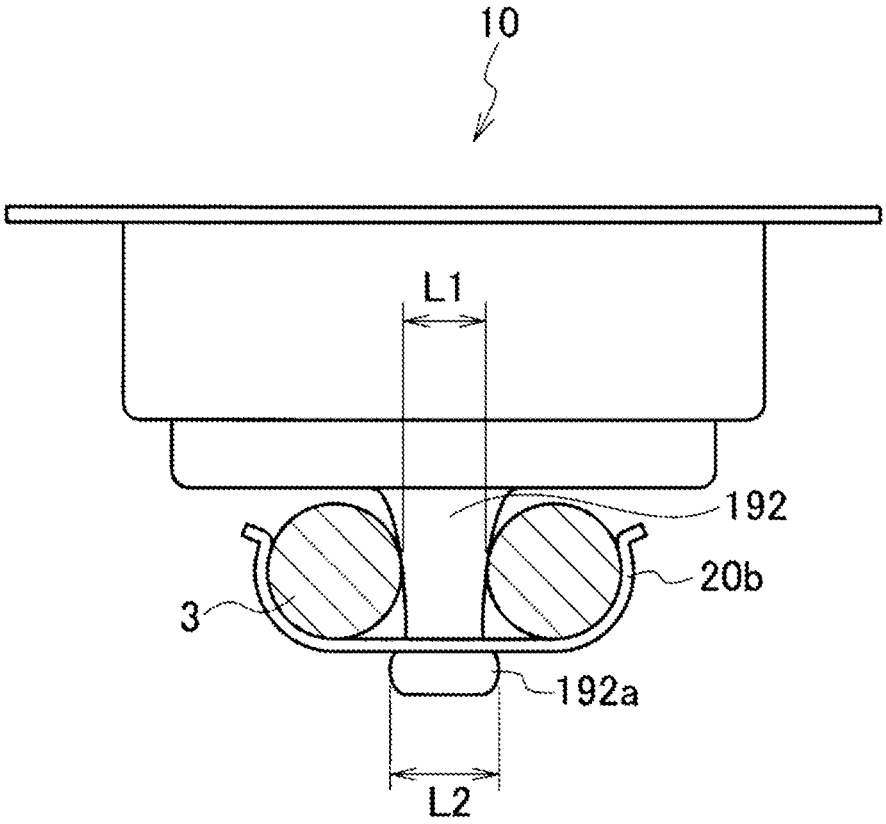
FIG. 14 is a front view of the housing member of the temperature switch.
Figure 15:
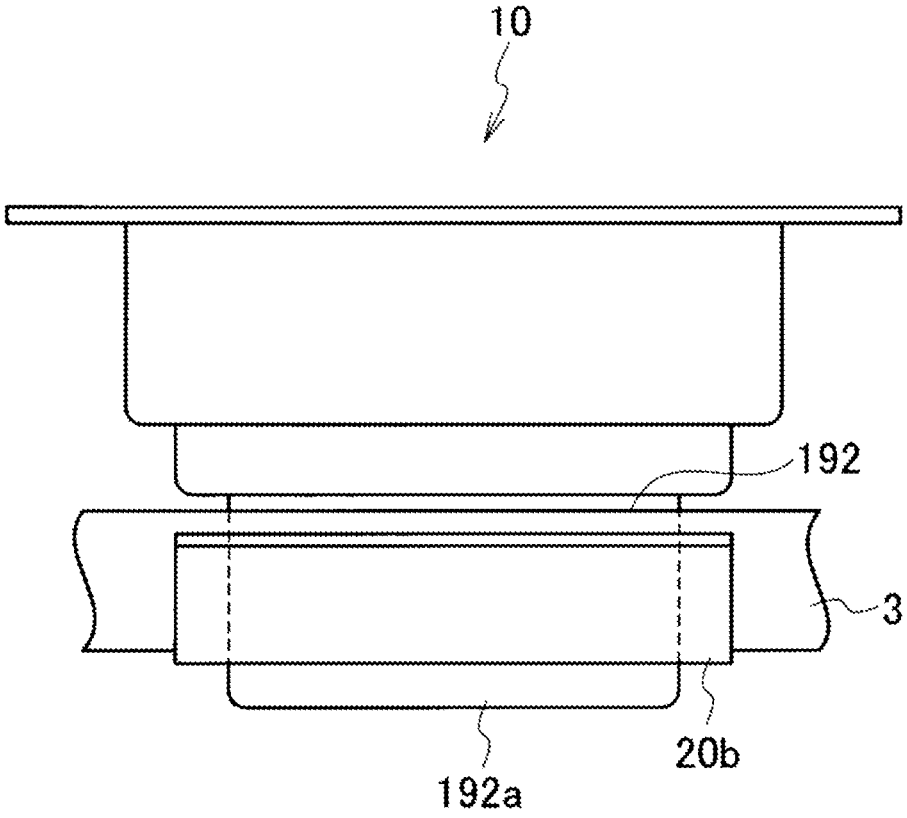
FIG. 15 is a side view of FIG. 14.

Next, a fourth embodiment of the present invention will be explained with reference to FIG. 13 to FIG. 15.

Figure 13:
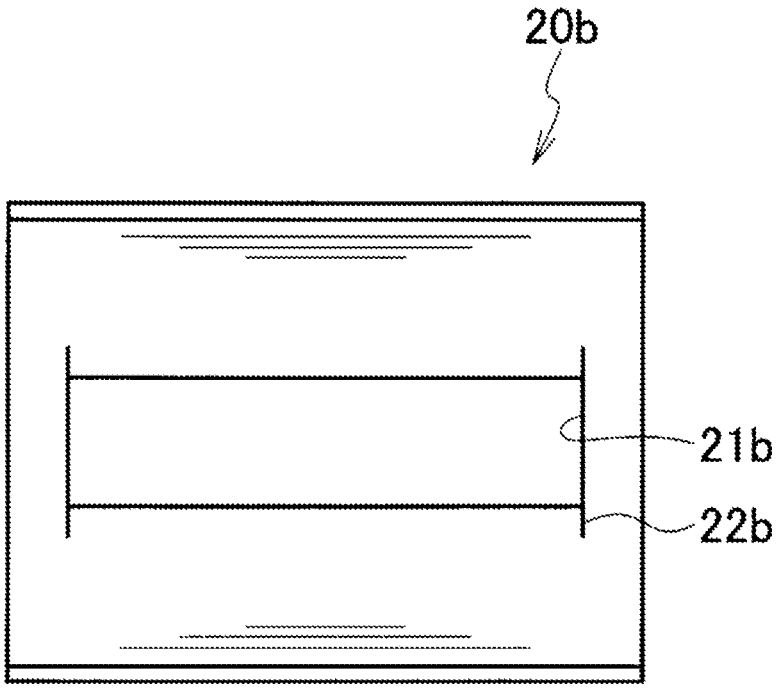
FIG. 13 is a plan view of the holding member of the fluid heating device according to a fourth embodiment of the present invention.

A holding member 20*b* of the fourth embodiment has the similar structure as that of the holding member 20*a* of the third embodiment, except that a locking hole 21*b* is formed therein, as illustrated in FIG. 13. The locking hole 21*b* is for locking a later-described tip portion 192*a* of a contact portion 192 of the bimetal switch 10, as illustrated in FIG. 14 and FIG. 15. Incidentally, according to this embodiment, a cut portion 22*b* is formed in the holding member 20*a* so that the tip portion 192*a* can be easily inserted into the locking hole 21*b*.

Further, the bimetal switch 10 of this embodiment has the same structure as that of the bimetal switch 10 of the third embodiment, except that the structure of the contact portion 192 is different from that of the third embodiment. With the bimetal switch 10 of this embodiment, as illustrated in FIG. 14, a width L2 of the tip portion 192*a* that is not in contact with the heater 3 is greater than a distance L1 between the pair of straight portions 3*c* of the heater 3. Then, the contact portion 192 is held while the tip portion 192*a* is penetrating through the locking hole 21*b*.

Incidentally, according to this embodiment, the contact portion between the bimetal switch 10 and the heater 3 is formed to have a small gradient, similarly to the third embodiment, so that a contact angle θ, when being in contact with the heater 3, becomes smaller.

According to this embodiment, the engagement between the tip portion 192*a* and locking hole 21*b* can prevent the holding member 20*b* from being detached from the heater 3.

Fifth Embodiment

Figure 16:
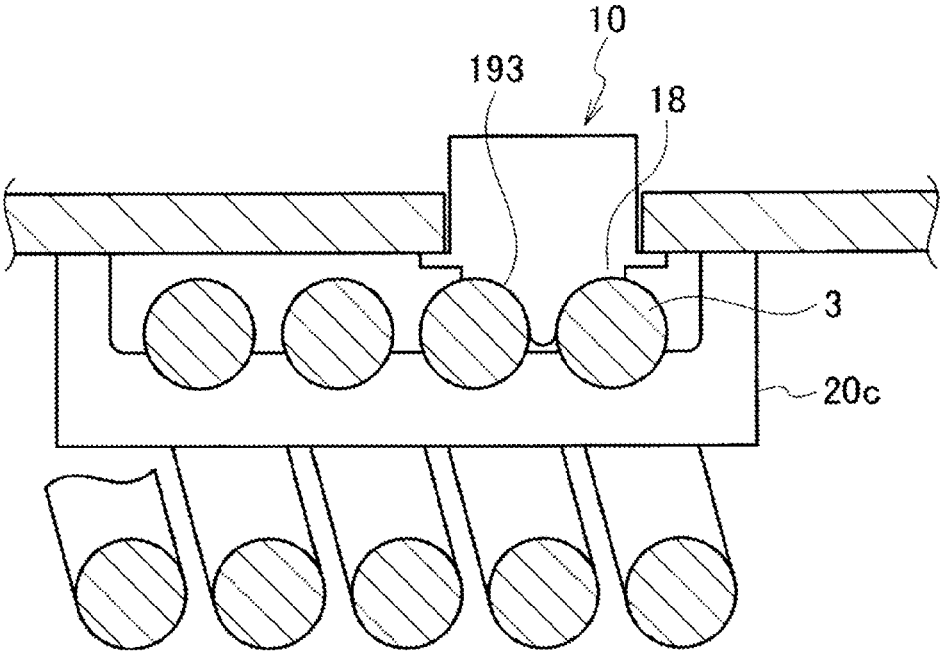
FIG. 16 is a partial cross-sectional view of the fluid heating device according to a fifth embodiment of the present invention.

Next, a fifth embodiment of the present invention will be explained with reference to FIG. 16.

With the bimetal switch 10 of the fifth embodiment, a contact portion 193 is formed to have a pair of curved surfaces that is able to be in surface-contact with the straight portions 3*c* of the heater 3. With the bimetal switch 10 of this embodiment, not only a surface of the contact portion 193, but also the bottom surface 18 is in contact with the heater 3. Further, according to this embodiment, the heater 3 and the contact portion 193 are fixed by the brazing.

The holding member 20*c* of this embodiment has the same structure as that of the holding member 20 of the first embodiment, except that the contact surface with the heater 3 is formed as the curved surface along a contour of the heater 3.

According to this embodiment, the contact area between the heater 3 and the bimetal switch 10 is increased by the above-described structure. In addition, a minute gap between the heater 3 and the bimetal switch 10 is filled by a brazing material used for the brazing, which makes it possible to further improve a heat transfer property. Particularly, this effect becomes more obvious according to this embodiment, because the contact portion 193 is inserted between the pair of straight portions 3*c* and the brazing is performed while the contact pressure is generated therebetween.

Embodiments of this invention were described above, but the above embodiments are merely examples of applications of this invention, and the technical scope of this invention is not limited to the specific constitutions of the above embodiments.

This application claims priority based on Japanese Patent Application No. 2012-177474 filed with the Japan Patent Office on Aug. 9, 2012 and Japanese Patent Application No. 2013-138869 filed with the Japan Patent Office on Jul. 2, 2013, the entire contents of which are incorporated into this specification.

The invention claimed is:

1. A heater device, comprising:

a heater; and a temperature switch configured to perform switching according to temperature of the heater, wherein the temperature switch includes:

a bimetal that is deformed when the temperature of the heater reaches a set temperature;

a switch mechanism that is opened and closed by deformation of the bimetal; and a housing member that houses the bimetal and the switch mechanism, and that is configured to conduct heat to the bimetal, wherein the heater includes a pair of heat generation units that are adjacent to each other, wherein the housing member includes a contact portion that is formed to project and that is inserted between the pair of heat generation units, and wherein the contact portion is larger than a distance between the pair of heat generation units in a state where the contact portion is not inserted between the pair of heat generation units, and wherein a contact pressure is generated between the contact portion and the pair of heat generation units in a state where the contact portion is inserted between the pair of heat generation units.

2. The heater device according to claim 1, wherein the contact portion is projected from a bottom surface of the housing member that faces the bimetal.

3. The heater device according to claim 1, wherein the pair of heat generation units are extended to be in parallel to each other, and wherein the contact portion is extended along the heat generation units.

4. The heater device according to claim 1, wherein each of the heat generation units is formed to have a ring-shaped cross section, and wherein the contact portion includes plane surfaces that are configured to circumscribe the heat generation units or curved surfaces that are configured to be in surface-contact with the heat generation units.

5. The heater device according to claim 2, wherein, in the bottom surface of the housing member, a portion that is in direct contact with the bimetal, or a portion that is in thermal contact with the bimetal via a heat transfer member is separated from the heater.

6. The heater device according to claim 1, wherein the contact portion is projected to taper down toward a tip of the contact portion.

7. A fluid heating device comprising:

a heater;

a temperature switch configured to perform switching according to temperature of the heater;

a tank that houses the heater and that allows a fluid to be supplied therein, to be heated by the heater, and to be circulated therethrough; and a holding member that holds the heater inside the tank, wherein the temperature switch includes a bimetal that is deformed when the temperature of the heater reaches a set temperature;

a switch mechanism that is opened and closed by deformation of the bimetal; and a housing member that houses the bimetal and the switch mechanism, and that is configured to conduct heat to the bimetal, wherein the heater includes a pair of heat generation units that are adjacent to each other, wherein the housing member includes a contact portion that is formed to project and that is inserted between the pair of heat generation units, and wherein the temperature switch is attached to the tank so as to be inserted from an outside of the tank to an inside of the tank to sandwich the heat generation units of the heater between the temperature switch and the holding member.

8. The fluid heating device according to claim 7, wherein the temperature switch is disposed by being separated from the holding member in a direction along the heat generation units.

9. The fluid heating device according to claim 7, wherein the heater is formed to have a winding shape that is wound in such a manner that the heat generation units are adjacent to each other, and wherein the holding member holds an inner circumference of the wound heater.

10. The fluid heating device according to claim 7, wherein the holding member fixes one of the pair of heat generation units that are adjacent to each other, between which the contact portion is inserted, and holds another heat generation unit to be separatable from the one heat generation unit.

11. The fluid heating device according to claim 7, wherein each of the heat generation unit includes a straight portion that is formed to have a straight shape, and a coupling portion that couples an end portion of the straight portion to another straight portion that is adjacent thereto, wherein the contact portion is in contact with the straight portion, and wherein the holding member holds the straight portion.

* * * * *